United States Patent [19]

Ferrier et al.

[11] 3,965,547

[45] June 29, 1976

[54] APPARATUS FOR PRODUCING BULKED YARNS

[75] Inventors: Duncan Cameron Ferrier; Thomas Berry, both of Tiverton, England; Karel Murenbeeld, Geneva, Switzerland

[73] Assignee: John Heathcoat & Co. Ltd., Tiverton, England

[22] Filed: May 21, 1973

[21] Appl. No.: 362,350

Related U.S. Application Data

[62] Division of Ser. No. 130,899, April 5, 1971, Pat. No. 3,810,285.

[30] Foreign Application Priority Data

Apr. 6, 1970 United Kingdom ..... 16192/70
June 29, 1970 United Kingdom ..... 31381/70

[52] U.S. Cl. ..... 28/1.3; 28/1.4; 28/1.6

[51] Int. Cl.[2] ..... D02G 1/20; D02G 1/16; D02G 1/12

[58] Field of Search ..... 28/1.3, 1.4, 1.6, 72.11, 28/72.12, 72.14

[56] References Cited

UNITED STATES PATENTS

| | | | |
|---|---|---|---|
| 2,584,043 | 1/1952 | Oberly | 28/1.4 X |
| 3,005,251 | 10/1961 | Hallden, Jr. et al. | 28/72.12 X |
| 3,093,878 | 6/1963 | Fieldman | 28/72.12 X |
| 3,105,349 | 10/1963 | Palm et al. | 28/72.12 X |
| 3,156,028 | 11/1964 | Weiss et al. | 28/1.4 X |
| 3,343,240 | 9/1967 | Parmeggiani et al. | 28/72.14 X |
| 3,409,956 | 11/1968 | Longbottom et al. | 28/1.3 |
| 3,468,002 | 9/1969 | Parker | 28/72.12 X |
| 3,576,058 | 4/1971 | Berg et al. | 28/1.3 |

FOREIGN PATENTS OR APPLICATIONS

| | | | |
|---|---|---|---|
| 233,939 | 6/1961 | Australia | 28/72.12 |

*Primary Examiner*—Robert R. Mackey
*Attorney, Agent, or Firm*—Larson, Taylor & Hinds

[57] ABSTRACT

Apparatus for producing bulked multifilament yarn incorporates a high pressure fluid passage debouching into an intermediate pressure expansion chamber. The high pressure fluid passage is formed with entries for yarn and high pressure fluid and the intermediate expansion chamber is formed with a yarn-deflecting surface and yarn-discharge passage both located across the chamber from the point where the high pressure fluid passage enters the chamber.

28 Claims, 6 Drawing Figures

FIG. 1

APPARATUS FOR PRODUCING BULKED YARNS

CROSS-REFERENCE TO RELATED APPLICATIONS

Figure 1:
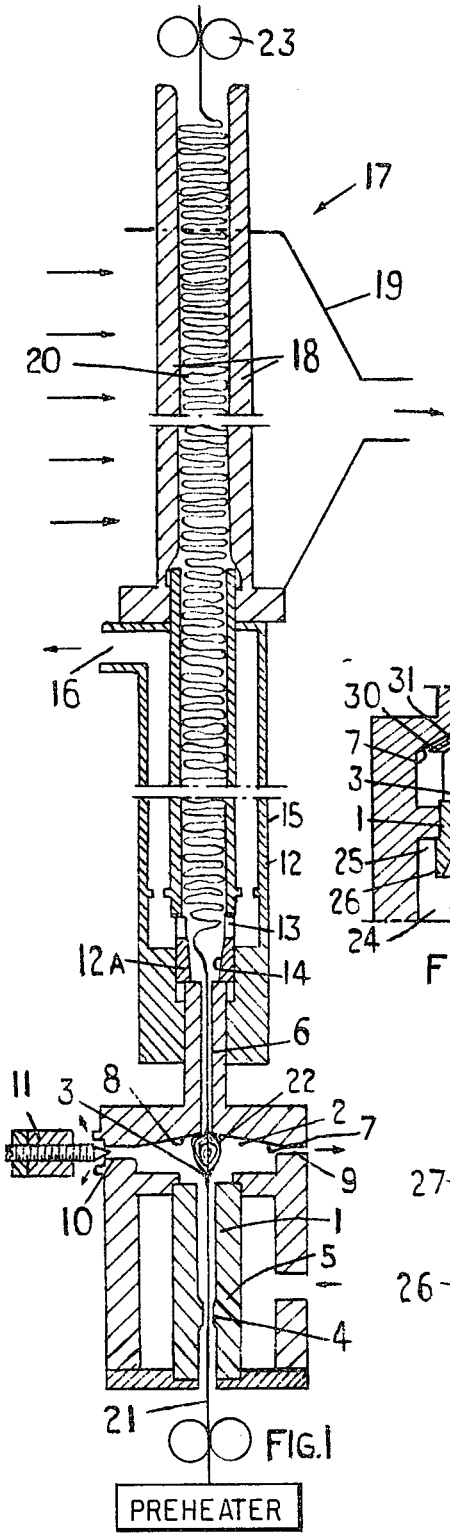

This is a division of application Ser. No. 130,899 filed Apr. 5, 1971, now U.S. Pat. No. 3,810,285, of May 14, 1974.

This invention relates to a method of producing bulked yarns and to apparatus for performing the method.

Methods of and apparatus for bulking yarns are well known but the known methods and apparatus suffer from the disadvantages that difficulty is experienced in bulking the treated yarn to a sufficient extent and the amount of bulking is difficult to control and is irregular in amount.

It is an object of the present invention to provide apparatus for producing bulked yarns which is capable of bulking yarn to a degree as great as is ever practically required and the degree of bulking is kept constant to within narrow limits. The invention also covers apparatus capable of additionally crimping thermoplastic yarn and stabilizing it.

According to the invention disclosed herein, but claimed in application Ser. No. 130,899, a method of producing bulked multifilament yarn includes the steps of impregnating a multifilament yarn with a gaseous fluid at one pressure, carrying the yarn continuously forward in a stream of the fluid, causing the fluid to expand suddenly to a lower pressure so as to cause the fluid to separate the yarn filaments as it expands to provide a degree of bulking of the yarn greater than that to be finally achieved, bringing the separated filaments towards one another and carrying the yarn continuously forward in a second stream of the fluid.

Where the yarn is a thermoplastic yarn, the fluid may be at a temperature high enough to plasticize the yarn.

The act of bringing the separated filaments of yarn towards one another may include the step of abruptly changing their direction of movement so as to crimp them.

The method may consist more particularly in initiating a first stream of hot gaseous fluid between a high pressure zone and an intermediate pressure zone and a second stream of the hot gaseous fluid between the intermediate pressure zone and a low pressure zone, immersing the yarn in the first stream of fluid so that it becomes impregnated with and is carried continuously forward by the fluid, causing the fluid of the first stream to expand suddenly into the intermediate pressure zone so that the yarn filaments become separated by the sudden expansion of the expanding fluid to provide a degree of bulking of the yarn greater than that to be finally achieved, abruptly changing the direction of movement of the separated filaments, then bringing the filaments together and entraining the yarn in the second stream of fluid so that it is carried by the fluid towards the low pressure zone.

The fluid in the high pressure zone may be non-turbulent.

The step of separating the yarn filaments may consist in separating the yarn filaments transversely in one plane only by permitting the fluid to expand transversely in one plane only.

Some of the expanded fluid may be bled off leaving a portion of the original fluid to form the second stream.

The method may include the additional step of crimpsetting the yarn by holding the yarn bulked to the desired degree in a non-tensioned condition for a period long enough to allow the yarn to set. The setting period may be reduced by cooling the non-tensioned yarn by applying to it a fluid at a temperature low enough to accelerate the setting rate.

The method may include the step of directing the yarn carried forward in the second stream of the fluid against one end of a plug formed of already bulked yarn and permitting the yarn to build up against the said end of the plug.

The method may include the step of preheating the yarn before it enters the first stream of hot gaseous fluid.

In accordance with the invention claimed in this application, apparatus for bulking yarn according to the method described may incorporate a high pressure fluid passage and an intermediate pressure expansion chamber into which the passage debouches, the passage being formed with an entry for yarn and an entry for high pressure gaseous fluid, and the intermediate pressure expansion chamber being formed with a yarn discharge passage, the entrance to which is located across the chamber from the debouchment of the high pressure fluid passage and containing a yarn-deflecting surface also located across the chamber from the debouchment of the high pressure fluid passage.

It is to be understood that the expressions "high pressure" and "intermediate pressure" are only relative. The respective pressures may both be superatmospheric, or may be superatmospheric and substantially atmospheric, respectively, or may be substantially atmospheric and sub-atmospheric, respectively.

Where the intermediate pressure chamber is to be maintained at a superatmospheric or atmospheric pressure, the pressure may be maintained at the desired intermediate pressure by escape of fluid through the yarn-discharge passage. Additionally at least one bleed-off opening may be provided in the intermediate pressure chamber. Means may be provided for varying the effective area of the bleed-off opening.

Where the intermediate pressure chamber is to be maintained at a sub-atmospheric pressure the chamber may be connectible to a vacuum producing means.

The high pressure fluid passage may be formed with an opening for entry of yarn co-axial with the debouchment of the passage and at least one lateral opening for entry of gaseous fluid.

The apparatus may incorporate a high pressure chamber from which the high pressure fluid passage leads to the intermediate pressure chamber. In this construction the entry for yarn and for high pressure fluid to the high pressure fluid passage may be a common opening through which both yarn and fluid can pass simultaneously and the high pressure chamber is formed with means for introducing yarn and for introducing high pressure gaseous fluid.

The high pressure fluid passage may debouch into the intermediate pressure chamber between two parallel walls so that fluid issuing from the passage into the intermediate pressure chamber is constrained to expand laterally in a thin sheet.

The passage and the parallel walls may be formed integrally in a member removably mounted in and penetrating a diaphragm separating the high pressure chamber and the intermediate pressure chamber.

The yarn-deflecting surface may be presented by a wall of the intermediate pressure chamber which is also formed with the yarn-discharge passage. Said wall of the intermediate chamber may be coned or tapered towards the yarn - discharge passage. Alternatively the deflecting surface may be constituted by a false wall spaced from the wall of the chamber formed with the yarn - discharge passage, said false wall being formed with a yarn-receiving opening co-axial with the said yarn - discharge passage.

The apparatus may include a crimp-setting section arranged to stabilize yarn after it has been bulked and crimped. This section may incorporate a stuffer tube co-axial with the yarn-discharge passage, the tube being formed with lateral ports near the end adjacent to the yarn-discharge passage and being surrounded by a heating jacket over at least a part of its length. The jacket may be open to the ports in the stuffer tube.

The bore of the stuffer tube at the end adjacent to the yarn-discharge passage may be convergent towards said end to prevent jamming of the plug. This is the yarn plug-forming portion of the stuffer tube and conveniently may be a piece separate from the rest of the tube and may be formed with the ports.

The apparatus may incorporate a cooler consisting of a tubular-form guide co-axial with the stuffer tube and arranged to receive the yarn plug formed in the stuffer tube, the tubular-form guide being air permeable and being at least partly surrounded by a cooling air casing. The tubular-form guide may be formed from parallel bars arranged at the corners of a polygon, e.g. four bars at the corners of a square, the plug passing along the guide while confined by the bars and while cooling air is passed between the bars through the plug.

The apparatus may incorporate yarn feed and/or take-off rollers for feeding yarn to and removing yarn from the apparatus.

The gaseous fluid may be air or steam.

Figure 2:
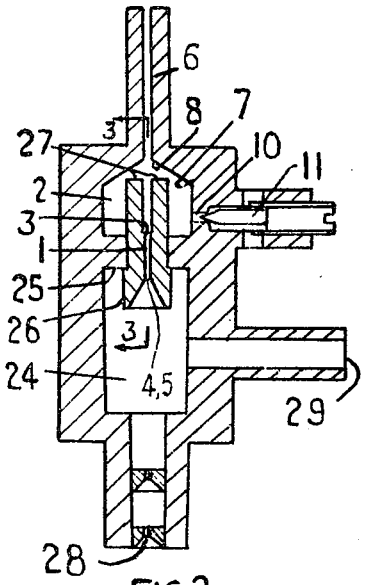
Figure 3:
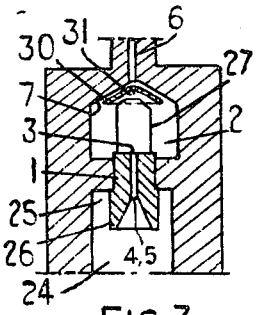
Figure 6:
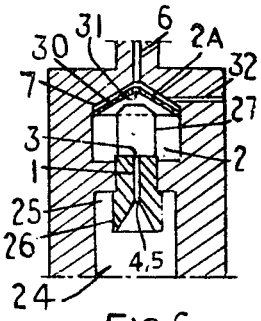
Figure 4:
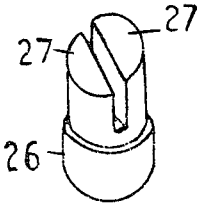
Figure 5:
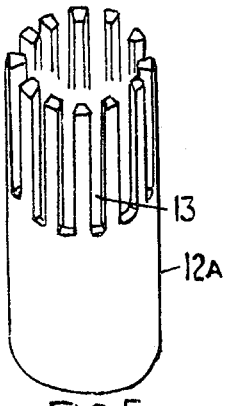

Practical embodiments of the invention are illustrated in the accompanying drawings in which FIG. 1 is a section of a complete installation, FIG. 2 is a section of a complete installation incorporating a yarn bulking apparatus of another form, FIG. 3 illustrates a modification of the yarn bulking apparatus shown in FIG. 2 but sectioned through the position indicated at 3—3 in FIG. 2, FIG. 4 is a perspective view of the member formed with the high pressure fluid passage and parallel walls between which the passage debouches, FIG. 5 is an illustration of the yarn plug-forming portion of the stuffer tube showing how it is formed as a separate piece slotted at one end, and FIG. 6 illustrates a modification of the yarn bulking apparatus illustrated in FIG. 3.

In the drawings 1 denotes a high pressure fluid passage and 2 denotes an intermediate pressure chamber into which the passage 1 debouches at 3. Numerals 4 and 5 denote entries for yarn and for high pressure gaseous fluid into the passage 1. The chamber 2 is formed with a yarn-discharge passage 6, the entry to which is located in the wall 7 across the chamber 2 from the debouchment 3 of the passage 1 into the chamber 2. The chamber 2 contains a yarn-deflecting surface 8 constituted by the coned wall 7 of the chamber 2 located across the chamber 2 from the debouchment 3 of the passage 1, and 9 and 10 denote bleed-off openings from the chamber 2, the opening 9 being uncontrolled and the opening 10 being associated with a needle valve 11 operable to vary the effective area of the opening 10.

The crimp-setting section of the apparatus incorporates a stuffer tube 12 disposed co-axial with the yarn-discharge passage 6 and formed with lateral ports 13 at the end adjacent to the yarn-discharge passage 6. The portion 12A of the stuffer tube 12 formed with the lateral ports 13 is separate from the main portion of the stuffer tube and is convergent internally towards the passage 6 as indicated at 14 (see particularly FIG. 5). 15 denotes a jacket surrounding most of the length of the stuffer tube, the ports 13 opening into the jacket 15, which latter has an exhaust opening 16.

A cooler 17 is arranged to receive a plug of yarn formed in the stuffer tube 12 and consists of a cage formed of parallel bars 18 disposed at the corners of a polygon, in the construction illustrated four bars at the corners of a square. 19 denotes a casing arranged to direct cooling air from a fan or suction device transversely through a plug of yarn 20 confined within the space enclosed by the bars 18. 21 denotes unbulked multifilament yarn entering the apparatus and 22 denotes the yarn filaments separated in the intermediate pressure chamber 2. 23 denotes yarn take-off rollers for removing yarn from the apparatus.

The construction of FIG. 2 incorporates a high pressure chamber 24 separated from the intermediate pressure chamber 2 by a diaphragm 25, the high pressure passage 1 being formed in a removable member 26 inserted through the diaphragm 25. The member 26 presents two spaced parallel walls 27 between which the high pressure passage 1 debouches. The high pressure chamber 24 has an entry 28 for yarn, which includes packing, as shown, to minimize escape of fluid from the chamber, and an entry 29 for high pressure gaseous fluid. In this construction yarn and high pressure gaseous fluid enter the high pressure passage 1 together through the same opening at the end of the passage 1 in the high pressure chamber 24.

FIG. 3 shows a construction closely resembling that of FIG. 2 but incorporating a deflecting surface constituted by a false wall 30 spaced from the wall 7 of the intermediate pressure chamber 2. The false wall 30 is formed with an aperture 31 co-axial with the yarn-discharge passage 6. The false wall 30 may be coned to an angle different from that of the coned wall 7 of the chamber 2 to provide desired pressure conditions at the entrance to the yarn-discharge passage 6. For example, the annular passage between the false wall 30 and the wall 7 may be divergent towards the yarn-discharge passage 6 so that fluid entering the passage 6 from the said annular passage on the outside of yarn entering the passage through the aperture 31 in the false wall 30 will be at a lower pressure than the fluid contained within the filaments of the yarn. The fluid passing along the passage 6 on the outside of the yarn will thus act as a gas lubricant for the yarn in the passage without compressing it and reducing its degree of bulking.

Also, the wall 7 is presented by a casing the outer surface of which is exposed to the ambient temperature, there is a continuous flow of heat away from the exterior of the casing. This loss of heat tends to reduce the temperature of the wall 7. The false wall, being wholly within the intermediate pressure chamber 2 and consequently completely surrounded by fluid at the operating temperature, and thus not exposed to the ambient temperature, can be maintained at a higher temperature than the wall 7 which being part of the chamber 2 which has an outer surface exposed to the ambient temperature is consequently continuously losing heat to the outer surface. The high temperature of the false wall has beneficial effects on the plasticization of the yarn striking it.

In the construction of FIG. 6 the false wall 30 separates the chamber 2 into two portions connected only by the aperture 31 and a passage 32 is provided for introduction of fluid into the space 2A between the false wall 30 and the wall 7 from a supply of fluid separate from that feeding the high pressure chamber 24. Arrangements may be made to control the pressure of the fluid entering the space 2A through the passage 32 separately from the fluid feeding the high pressure chamber 24.

In practice, and referring particularly to FIG. 1, untreated yarn 21 enters the high pressure passage 1 through the entry 4 and meets hot high pressure gaseous fluid entering the passage 1 through the entry 5. In the passage 1 the yarn is heated by and impregnated with the fluid and as the fluid flows along the passage to the intermediate pressure chamber 2, where a lower pressure prevails, it entrains the yarn and carries it forward. When the fluid enters the intermediate chamber 2 it expands. As the fluid impregnating the yarn expands with the rest of the fluid the yarn filaments are caused to separate as shown at 22.

Because of the premixing of the fluid and the yarn in the passage 1 the entry of the mixed fluid and yarn together into the lower pressure in the intermediate chamber 2 provides a high degree of separation of the yarn filaments and as a consequence a high and uniform degree of heat transfer and consequently a high degree of uniformity of plasticity throughout the filaments of the yarn. Changing abruptly the direction of movement of the filaments by causing them to impact the deflecting surface 8 constituting the wall 7 of the chamber 2 causes them to become crimped. The bulked yarn filaments are then brought together and carried through the passage 6 by fluid from the chamber 2 flowing towards the lower pressure conditions prevailing at the other end of the passage 6.

When the bulked yarn and the fluid leave the passage 6 the fluid escapes through the ports 13 into the jacket surrounding the stuffer tube 12 which is thereby heated, and the yarn is projected against the adjacent end of the plug 20 of yarn which has been allowed to form in the stuffer tube. The crimp imparted in the intermediate chamber 2 is enhanced by the impact of the yarn against the plug 20. The plug diameter is determined at the point where the plug is continuously formed and advantage is taken of this event to ensure that jamming of the plug of yarn never takes place. This is done by tapering the end of the stuffer tube where the plug forms as is indicated at 14. Actually as has been previously described, in the construction employed here the tapered portion is formed for convenience of manufacture in a separate part of the stuffer tube which is also formed with the ports 13 (See FIG. 5). The plug formed in the tapered portion is of slightly smaller diameter than the diameter of the main portion of the stuffer tube so that as the plug grows and is pushed upwards by the fluid pressure below the plug it remains an easy fit in the stuffer tube 12.

The yarn plug moving along the part of the stuffer tube surrounded by the jacket 15 is maintained hot and the yarn therein in a non-tensioned state. This permits uniformity of temperature to be achieved throughout the plug. The yarn plug then enters the cooler 17 and continues its movement between the bars 18. Here cooling gas, e.g. a current of cool air, flows transversely through the plug and cools and sets the yarn. The crimp-set yarn is removed by the take-off rollers 23.

In the modified construction of FIG. 2, the yarn is preheated in the high pressure chamber 24 before entering the high pressure passage 1 and when the yarn issues from the passage 1 into the intermediate pressure chamber 2 it does so between the closely spaced walls 27. The fluid is thus constrained to expand laterally in a sheet, the filaments then separating into a more or less flat fan shape. This has been found to provide a very desirable bulking effect in certain yarns.

In the construction of FIG. 3, the separated filaments have their directions of movement abruptly changed by impacting against the false wall 30 which acts as the deflecting surface. The filaments are brought together to provide the desired amount of bulking in passing through the orifice 31 in the false wall 30, thereafter entering the yarn discharge passage 6 along with contained gaseous fluid and gaseous fluid entering the passage 6 from between the false wall 30 and the wall 7 of the chamber 2.

Yarn always contains a certain quantity of foreign matter such as grit and grease and it has been found that there is sometimes a tendency for some of this foreign matter to become deposited in the passage 6 with a resultant drop in the efficiency of operation of the apparatus. The construction of FIG. 6 reduces greatly or eliminates completely this trouble in addition to any other benefits conferred by the use of the false wall 30. The fluid entering the space 2A through the passage 32 has not been in contact with yarn and is consequently clean. In entering the yarn-discharge passage 6 with the yarn, the clean fluid forms a sheath containing little or no foreign matter around the yarn traversing the passage 6 and prevents the deposit of foreign matter from the yarn in the passage 6.

The process and apparatus of the invention have been found to be completely satisfactory in producing at high speed and at low cost bulked yarns in all deniers but particularly in a denier range in which existing methods and apparatus cannot function or can function only with difficulty and/or with high cost. This range is that lying between deniers 60 and 4000.

The yarns produced by the method and apparatus of the invention have a stable crimp of the helical three dimensional type with non-torque characteristics.

What is claimed is:

1. Apparatus for bulking yarn incorporating a high pressure fluid passage and an intermediate pressure expansion chamber into which the passage debouches, the passage being formed with an entry for yarn and an entry for high pressure gaseous fluid spaced upstream from said expansion chamber such that yarn will become impregnated with high pressure fluid in said passage, a high pressure chamber from which the high pressure fluid passage leads to the intermediate pressure chamber, the entry for yarn and for high pressure fluid to the high pressure fluid passage being a common opening through which both yarn and fluid can pass simultaneously, the high pressure chamber being formed with means for introducing yarn and means for introducing high pressure gaseous fluid, and the intermediate pressure expansion chamber being formed with at least one fluid bleed-off opening and with a yarn discharge passage the entrance to which is located across the chamber from the debouchment of the high pressure fluid passage and containing a yarn deflecting surface also located across the chamber from the debouchment of the high pressure fluid passage.

2. Apparatus as claimed in claim 1 in which the means for introducing yarn to the high pressure chamber is a yarn entry passage incorporating means to minimize the escape of fluid from the high pressure chamber when is pressurized.

3. Apparatus as claimed in claim 1 in which the yarn deflecting surface is presented by a wall of the intermediate pressure expansion chamber which is also formed with the yarn-discharge passage.

4. Apparatus as claimed in claim 3 in which the wall of the intermediate pressure expansion chamber serving as the yarn-deflecting surface is tapered toward the yarn discharge passage.

5. Apparatus as claimed in claim 1 in which the yarn deflecting surface is constituted by a false wall spaced from the wall of the intermediate pressure expansion chamber formed with the yarn discharge passage, said false wall being formed with a yarn receiving opening coaxial with the said yarn discharge passage.

6. Apparatus as claimed in claim 5 in which the false wall separates the intermediate pressure expansion chamber into two portions connected only by the yarn-receiving opening in the false wall and in which means is provided for introducing into the space between the false wall and the wall formed with the yarn discharge passage gaseous fluid under pressure from a supply separate from that introduced to the high pressure fluid passage.

7. Apparatus as claimed in claim 6 wherein the fluid introducing means comprises a fluid-introducing passage debouching into the space between the false wall and the wall formed with the yarn discharge passage, said fluid introducing passage being connected to a controlled supply of fluid.

8. Apparatus as claimed in claim 1 incorporating yarn take-off rollers for removing yarn from the apparatus.

9. Apparatus for bulking yarn incorporating a high pressure fluid passage and an intermediate pressure expansion chamber into which the passage debouches, the passage being formed with an entry for yarn and for high pressure gaseous fluid, the intermediate pressure expansion chamber being formed with a yarn discharge passage the entrance to which is located across the chamber from the debouchment of the high pressure fluid passage and containing a yarn deflecting surface also located across the chamber from the debouchment of the high pressure fluid passage, at least one bleed-off opening provided in the intermediate pressure expansion chamber, and two laterally extending parallel walls between which the high pressure fluid passage debouches into the intermediate pressure expansion chamber for constraining fluid issuing from the high pressure fluid passage into the intermediate pressure expansion chamber to expand laterally in a thin sheet between said parallel walls.

10. Apparatus as claimed in claim 9 further comprising a high pressure chamber, a diaphragm separating said intermediate pressure expansion chamber from the high pressure chamber, and wherein the high pressure fluid passage and the laterally extending parallel walls are formed integrally in a member removably mounted in and penetrating said diaphragm.

11. Apparatus for producing bulked multifilament yarn in which the yarn filaments are separated to a predetermined extent, comprising impregnating and carrying means for impregnating a multifilament yarn with a gaseous fluid at one pressure and carrying the yarn continuously forward in a stream of the fluid, expansion means comprising an expansion chamber for causing the fluid to expand suddenly to a lower pressure chosen to cause the fluid as it expands outwardly to separate the yarn filaments to an extent greater than said predetermined extent, and deflecting and carrying means, including a deflecting surface in said chamber against which the separated filaments are brought and a yarn discharge passage from said chamber, for causing said filaments to come toward one another in an amount such that the yarn filaments are separated to the said predetermined extent, and for carrying the yarn continuously forward in a second stream of the fluid, said expansion chamber having at least one bleed-off opening for fluid.

12. Apparatus as claimed in claim 11 wherein said impregnating and carrying means includes a high pressure fluid passage formed with entry means for yarn and high pressure gaseous fluid spaced upstream from said expansion chamber, said expansion chamber comprising an intermediate pressure expansion chamber into which said high pressure fluid passage debouches, and said deflecting and carrying means including said yarn deflecting surface and said yarn discharge passage located across said chamber from the debouchment of said high pressure fluid passage.

13. Apparatus as claimed in claim 12 wherein said high pressure fluid passage includes a relatively narrow passage leading to said intermediate pressure expansion chamber and a relatively enlarged high pressure chamber upstream of the relatively narrow passage.

14. Apparatus as claimed in claim 13 wherein said relatively enlarged high pressure chamber is formed with means for introducing yarn and means for introducing high pressure gaseous fluid, and said entry means for yarn and high pressure gaseous fluid comprises a common opening through which both yarn and fluid can pass simultaneously from said relatively enlarged high pressure chamber into said relatively narrow passage.

15. Apparatus as claimed in claim 13 wherein said relatively enlarged high pressure chamber is formed with means for introducing high pressure gaseous fluid, and said entry means for yarn and high pressure gaseous fluid comprises an opening through which fluid can pass from said relatively enlarged high pressure chamber into said relatively narrow passage, and an opening through which yarn can pass directly into said relatively narrow passage to join with fluid therein.

16. Apparatus as claimed in claim 12 wherein said high pressure fluid passage and said yarn discharge passage are relatively narrow and said expansion chamber is relatively wide in cross sections, the axis of said high pressure fluid passage defines the path for the yarn and high pressure fluid at the point of debouchment into said expansion chamber, and the entrance to said yarn discharge passage is substantially aligned with said axis.

17. Apparatus as claimed in claim 12 wherein the distance along said high pressure fluid passage between said entry means for yarn and high pressure fluid, on the one hand, and the point of debouchment, on the other hand, is sufficiently large to ensure impregnation of the yarn by the fluid before debouchment thereof into said expansion chamber, said bleed-off opening removing a portion of the fluid such that only part of the entering fluid leaves said expansion chamber with the yarn through said yarn discharge passage.

18. Apparatus for bulking yarn incorporating a high pressure fluid passage and an intermediate pressure expansion chamber into which the passage debouches, the passage being formed with entry means for yarn and for high pressure gaseous fluid spaced upstream from the debouchment of the passage into the intermediate pressure expansion chamber such that the yarn becomes impregnated with the high pressure fluid in said passage, said chamber being formed with at least one fluid bleed-off opening and with a yarn discharge passage the entrance to which is located across the chamber from the debouchment of the high pressure fluid passage and containing a yarn-deflecting surface also located across the chamber from the debouchment of the high pressure fluid passage.

19. Apparatus as claimed in claim 18 incorporating a high pressure chamber from which the high pressure fluid passage leads to the intermediate pressure expansion chamber, the entry for yarn and for high pressure fluid to the high pressure fluid passage being a common opening through which both yarn and fluid can pass simultaneously, the high pressure chamber being formed with means for introducing yarn and for introducing high pressure gaseous fluid.

20. Apparatus as claimed in claim 19 incorporating a diaphragm separating the high pressure chamber and the intermediate pressure expansion chamber, and a member removably mounted to penetrate said diaphragm, said member being formed with the high pressure fluid passage and with two parallel walls located one on each side of the discharge end of the high pressure fluid passage, the member being so fitted in the diaphragm that the parallel walls are within the intermediate pressure expansion chamber.

21. Apparatus as claimed in claim 19 in which the means for introducing yarn to the high pressure chamber is a yarn entry passage incorporating means to minimize the escape of fluid from the high pressure chamber when pressurized.

22. Apparatus as claimed in claim 18 incorporating two parallel walls located in the intermediate pressure expansion chamber on opposite sides of the debouchment of the high pressure fluid passage in said chamber, the walls being parallel to the axis of discharge of said high pressure fluid passage.

23. Apparatus as claimed in claim 18 in which means are provided for varying the effective area of the bleed-off opening.

24. Apparatus as claimed in claim 18 in which the high pressure fluid passage is formed with an opening for entry of yarn coaxial with the debouchment of the passage and at least one lateral opening for entry of gaseous fluid.

25. Apparatus as claimed in claim 18 in which the yarn-deflecting surface is constituted by a false wall spaced from the wall of the intermediate pressure expansion chamber formed with the yarn discharge passage, said false wall being formed with a yarn receiving opening coaxial with the said yarn discharge passage.

26. Apparatus as claimed in claim 25 in which the false wall separates the intermediate pressure expansion chamber into two portions connected only by the yarn receiving opening in the false wall and in which means is provided for introducing into the space between the false wall and the wall formed with the yarn discharge passage gaseous fluid under pressure from a supply separate from that introduced to the high pressure fluid passage.

27. Apparatus as claimed in claim 26 wherein the fluid introducing means comprises a fluid-introducing passage debouching into the space between the false wall and the wall formed with the yarn discharge passage, said fluid introducing passage being connected to a controlled supply of fluid.

28. Apparatus as claimed in claim 18 wherein said entry for gaseous fluid is connected to a supply of hot high pressure gaseous fluid.

* * * * *